United States Patent [19]

DeBin et al.

[11] Patent Number: 4,638,702

[45] Date of Patent: Jan. 27, 1987

[54] WEB CUTTING METHOD AND APPARATUS

[75] Inventors: René F. DeBin, Aalst; Emiel Y. Lambrecht, Gijzegem - Aalst, both of Belgium

[73] Assignee: FMC Corporation, Chicago, Ill.

[21] Appl. No.: 631,694

[22] Filed: Jul. 17, 1984

[51] Int. Cl.[4] ..... B26F 1/00; B26D 1/45

[52] U.S. Cl. ..... 83/509; 83/510; 83/566; 83/659; 83/701

[58] Field of Search ..... 83/50, 509, 510, 511, 83/701, 565, 566, 659

[56] References Cited

U.S. PATENT DOCUMENTS

| | | | |
|---|---|---|---|
| 676,677 | 6/1901 | Du Brul | 83/510 |
| 693,253 | 2/1902 | Follows | 83/510 |
| 782,931 | 2/1905 | Tyberg | 83/510 |
| 859,982 | 7/1907 | Schaeffer | 83/510 |
| 2,772,736 | 12/1956 | Campbell | 83/510 |
| 3,703,118 | 11/1972 | Spengler | 83/510 X |

*Primary Examiner*—Donald R. Schran

*Attorney, Agent, or Firm*—R. B. Megley; L. J. Pizzanelli

[57] ABSTRACT

The disclosed cutting method and apparatus produces a pattern cut in web material by providing a generally conically-shaped rotatable anvil and oppositely disposed knife edge shaped to produce the pattern cut. The axes of symmetry containing the apex of the cone is positioned at an acute angle to the axes about which the cone is rotated. With the web positioned over the knife, the knife is brought into pressure engagement with the anvil thereby piercing the web substantially at a point. Rotation of the anvil effects progressive cutting as the anvil surface traces the cutting edge of the knife.

6 Claims, 11 Drawing Figures

FIG_1
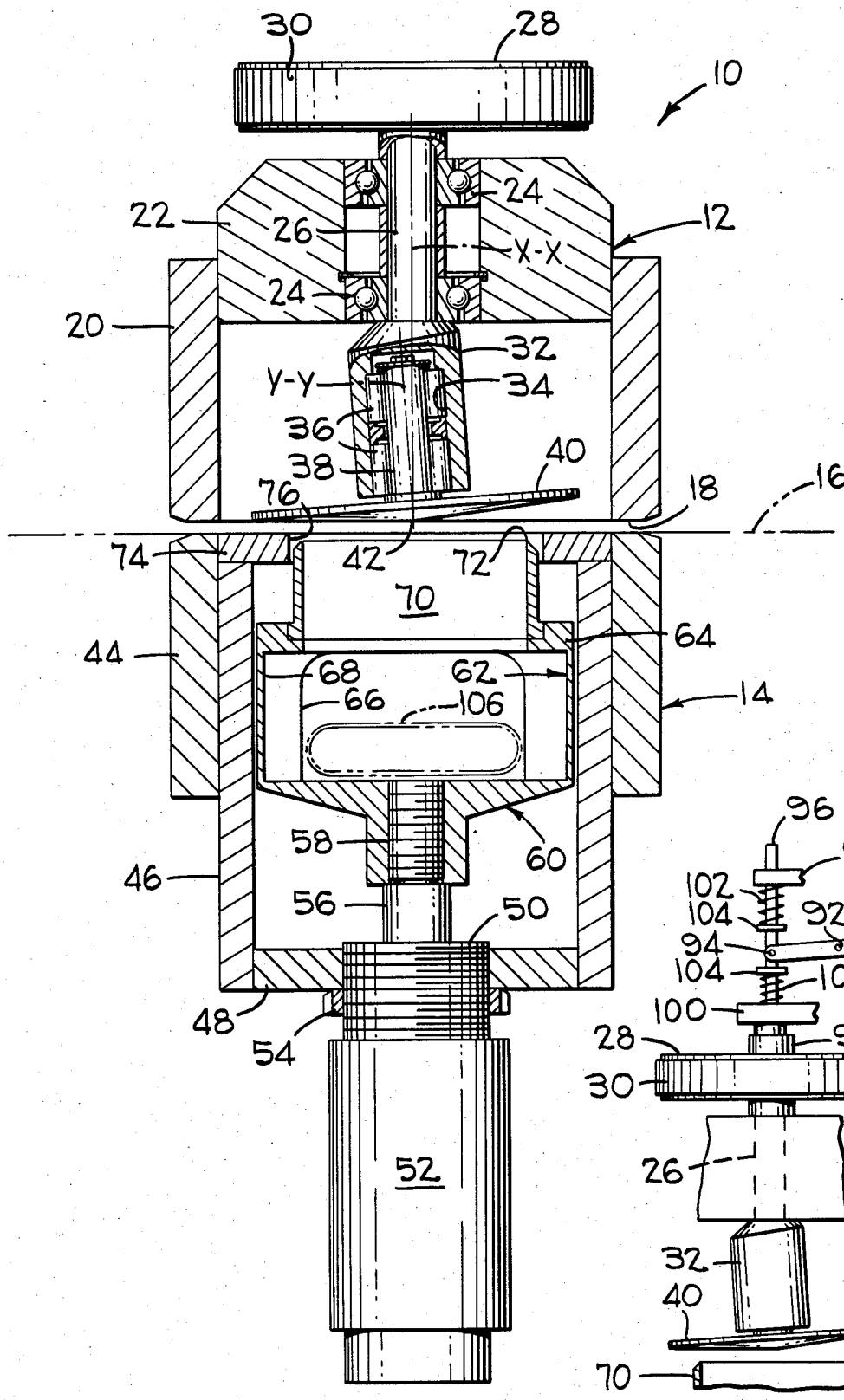
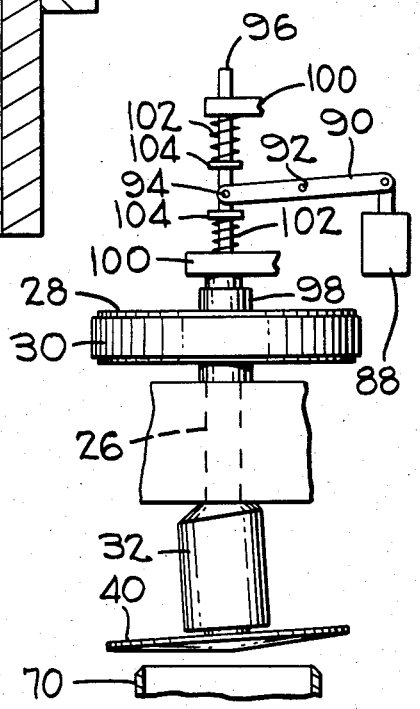
FIG_6

WEB CUTTING METHOD AND APPARATUS

This invention relates to cutting of web material and more particularly to cutting apperatures of selected configurations in webs of paper, foil or thermoplastic.

In the manufacture of thermoplastic handle bags of the type of having in-line apperatures, adjacent to the upper edge and in each of the opposed panels, it is conventional to make the apperatures by using a punch and die operating to apply a shearing force along the desired line of cut. While punch and die sets achieve satisfactory performance the life cycle of the cutting edges, particularly with thermoplastic webs, is relatively short requiring frequent replacement with sharpened die sets. To illustrate, current handle bag making machines that may be set up to produce, from a single lane, bags at a rate from 100 to 135 bags per minure obviously require the same rate of die set operation. At such a cycle rate rapid deterioration of the die sets occurs. Moreover, during a period of time in which the cutting edges lose their sharpness and in view of the fact that thermoplastics of the type used for making bags exhibits a high degree of resistance to being cut, the edges of the cut line may be deformed and produce an undesirable appearance.

The approach of the present invention departs from known present practices by penetrating the web, overlying or underlying a knife edge, at one or more points by a rigid anvil defining tangential contact with the knife edge. In making contact the web is pierced at the point of tangency and the contact pressure between the knife is maintained at least until the entire edge of the knife has been traversed by the anvil. In the course of the anvils excursion along the knife edge a portion of the web, corresponding to the shape of the knife, is cut and removed from the web.

Accordingly it is a principle feature of the present invention to cut web material by penetrating the web at one or more points at which an anvil structure makes tangential pressure engagement with a knife edge and progressively moving the anvil along the knife edge to effect cutting of the web.

BRIEF DESCRIPTION OF THE DRAWINGS

FIG. 1 is an elevation, partly in section, of the novel cutting apparatus constructed in accordance with the present invention, FIG. 8 is a modified form of the cutter when the cone-shaped anvil is displaced by the solenoid toward the lower disposed stationary knife.

DESCRIPTION OF THE PREFERRED EMBODIMENT

Figure 7A:
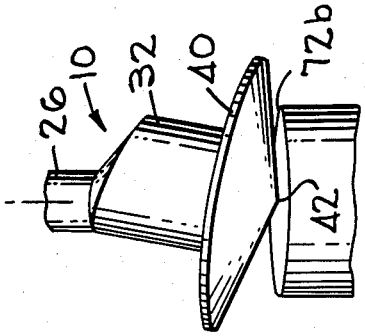
FIGS. 7A and 7B show the anvil cooperating with a knife structure for producing a cut along a knife edge having the form illustrated by the dashed lines defining a closed path.

FIG. 1 illustrates the general arrangement of the novel cutting apparatus of the present invention and it is generally designated by the numeral 10. While the description of the preferred construction of the present invention will be related to its use with a machine for producing thermoplastic bags, it is to be understood that the cutting principles disclosed herein are generally applicable to cutting thin filmy webs of paper, foil or thermoplastics. The cutting apparatus comprises an upper housing 12 and an aligned lower housing 14. An elongate strip of web material 16 is disposed in a gap 18 between the upper and lower housing. When the novel cutting mechanism of the present invention is mounted on and coordinated with the operation of a thermoplastic bag making machine the web 16 is intermittently advanced between the housings and during its period of repose or dwell the cutting mechanism is rendered operative to cut out the portion of the web which is within the projected area of the cutting elements which will be described hereinafter.

The upper housing 12 comprises a tubular shroud or casing 20 and a plug or a block 22 rigid with the casing 20. The block 22 rotatably mounts, by means of bearings 24, a shaft 26 the upper end of which has keyed thereon a pulley 28 which is rotated by a belt 30 driven by a motor (not shown). Integral with the shaft 26 is a depending bell-shaped housing 32. The housing is provided with a bore 34 formed along an axis Y—Y defining an angle of inclination with the axis X—X of the shaft 26. By means of bearings 36 a short stub shaft 38 is rotatably mounted in the bell housing 32 and it has rigidly secured to its lower end an anvil 40 taking the form of a shallow cone whose apex is indicated by numeral 42. It should be noted that the apex 42 is located at the intersection of the imaginary axis Y—Y and the imaginary axis X—X. As a result of this arrangement, rotation of the shaft 26 imparts an orbital motion to the bell housing 32 and the shallow cone-shaped anvil 40 while the apex 42, which lies on the axis X—X of the shaft 26, remains stationary. In other words, the apex 42 will not describe a circular locus.

The lower housing comprises an outer tubular casing 44 and an inner concentric tubular casing 46 being closed at its lower end by an annular plate 48 having a central threaded bore for receiving the threaded end 50 of a fluid operated linear actuator 52. The actuator is held firmly and clamped to the plate 48 by a lock nut 54.

The output rod 56 of the actuator 52 is threadedly connected at 58 to a cup-shaped knife holding platen 60 formed with a hollow portion 62 and an upper knife holding ledge 64. The hollow portion 62 is formed with an opening 66 in a circumferential wall portion 68.

The knife holding or retaining ledge 64 has a tubular knife 70 of any desired configuration (FIG. 6B or FIG. 7B) having its upper edge chamfered or ground to form a sharpened edge 72 which, as will be explained presently, cooperates with the anvil 40 to cut a hole in the web portion within the projected line of the edge 72.

According to the present invention the anvil 40 and the knife 70 comprise means for penetrating the web materials 16 when the knife is raised by the actuator 52. On raising the knife so that its edge 72 makes contact with the inclined anvil 40 a point of the web is penetrated since the inclined orientation of the anvil defines a point of tangency. It is to be recognized that the scope of the present invention contemplates the use of one or more rollers whose axes of rotation may be normal to the axes of the shaft 26 and thus achieve initial point contact which migrates along the knife edge 72 to achieve cutting a pattern hole from the web material 16. Accordingly, a principle objective of the present invention is to cut an apperature in flexible web material by penetrating the material at a point of tangency between an anvil and a cutting edge and progressively moving the point of contact along the entire edge of a knife.

Figure 7B:
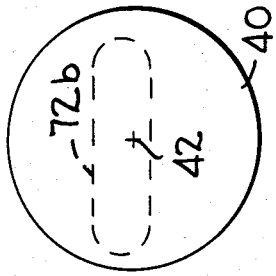
Figure 6A:
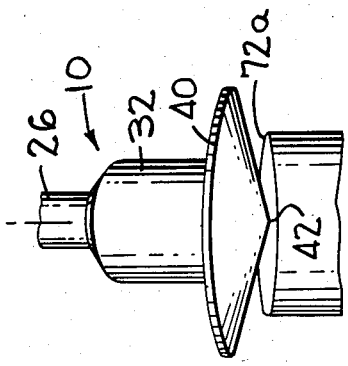
FIGS. 6A and 6B show the anvil associated with the knife formed for producing hand receiving holes of crescent shape.
Figure 6B:
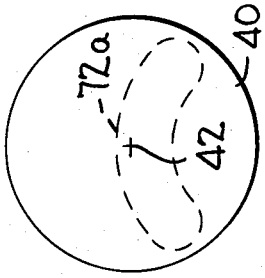

As shown in FIG. 1 the lower housing 14 includes a plate 74 having an apperature 76 which may be circular or of a configuration similar to the configuration of the knife such as shown in FIG. 6B and 7B. In any event, the apperature 76 is sufficiently large to provide clearance for upward projection of the knife toward and in contact with the anvil in response to the actuation of the linear actuator 52. Since it is contemplated that the web 16 would be held in tension during its progress over the cutting apparatus 10, raising of the knife 70 would slightly increase the tension of the web when contact of the anvil 40 is made. However, as the point of contact between the anvil 40 and the knife edge 72 progresses around the entire periphery of the knife edge 72 some relaxation and tension would occur as the cutting point progresses around the sharpened edge 72.

Figure 2:
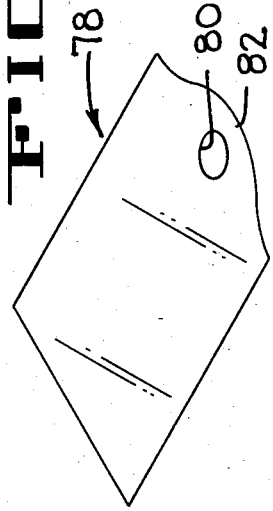
FIG. 2 is a perspective of a typical bag, usually referred to as a sinus top bag, provided with a hand receiving holes adjacent its upper margins.

FIG. 2 illustrates one type of thermoplastic bag, commonly referred to as a "sinus top bag" which is generally identified by the numeral 78. It will be observed that the bag 78 is provided with hand receiving holes 80 in each of the opposed panels (not shown) and that the holes 80 are located adjacent the curvilinear or top portion 82 of the bag.

Figure 3:
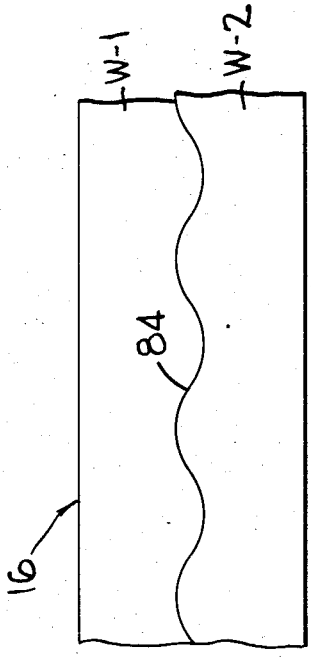
FIG. 3 is a plan illustrating an elongate strip of web material which has been divided into two web strips with the parting line taking the form of a sine wave.

FIG. 3 illustrates the portion of an elongate strip of web 16 which has been divided substantially along its longitudinal median along a sinusoidal parting line 84 to produce two web strips W-1 and W-2. Thereafter the web strips are arranged, either by advancing one web strip of retarding the other, to assume the orientation shown in FIG. 4. It should be particularly noted the web strips are oriented so that the top portion 82 of the respective bags are laterally aligned and overlapped to allow the cutting apparatus 10 to produce the hand receiving hold 80 in each prospective bag upon severing and sealing along a transverse line 86. It should also be appreciated that two bags are produced, one from each web strip W-1 and W-2, during each machine cycle.

Figure 4:
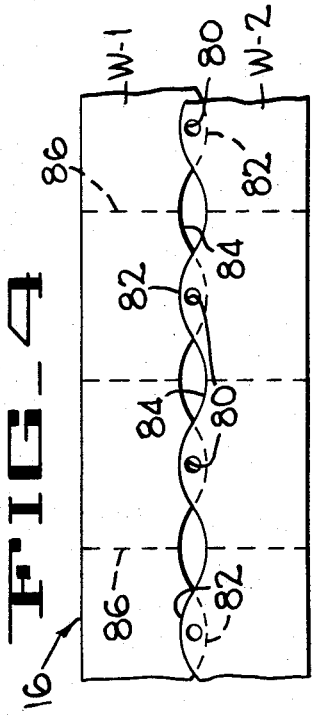
FIG. 4 shows the web strips illustrated in FIG. 3 displaced to the extent that the crown and the valley of each web strip is inline and illustrating the presence of hand receiving holes in a crown portion of the upper edge of a prospective bag.

For further details of a bag machine for producing the sinusoidal parting line 84 and aligning the web strips as shown in FIG. 4, reference should be made to Belgian application Ser. No. 212,638 filed on March 27, 1984 and assigned to the assignee of the present application. By reference to this application it is intended that is disclosure be incorporated herein.

Figure 5A:
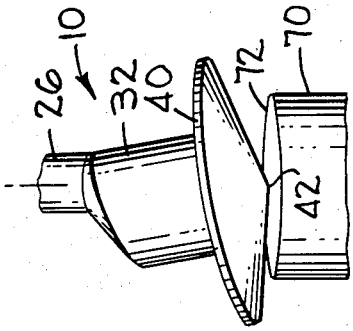
FIGS. 5A and 5B show a cone-shaped anvil cooperating with a circular knife to produce a circular hole in the thermoplastic web.
Figure 5B:
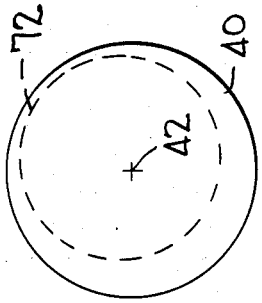

FIGS. 5*a* and 5*b* diagrammatically illustrate operation of the cutting apparatus when combined with the circular knife edge 72 to produce a round hole, such as hole 80 in the bag 78. It should be evident that as long as the knife edge 72 is within the projected area of the anvil 40 and that the apex 42 of the anvil is within the perimeter of the knife edge, irrespective of its shape, initial tangential contact piercing the web and progressing around the periphery of the knife will achieve cutting of a variety of shapes.

FIGS. 6*a* and 6*b* illustrate operation of the cutting apparatus with a knife having a configuration following the outlined indicated as 72*a*. It should be noted that the apex 42 is represented by the intersecting lines located within the periphery of the shape 72*a* of FIG. 6*b*. The anvil, as it is rotated, will progress from its point of contact around the knife edge 72*a* until an apperature of the illustrated configuration is produced.

FIGS. 7*a* and 7*b* illustrate a modified form of the knife edge 72*b* which essentially takes the form of two parallel rectalinear edges having their ends interconnected by a semicircle. It should be observed that the apex 42 of the anvil 40 is located within the periphery 72*b* but eccentric with the intersection of its axes of symmetry. Cutting in the manner disclosed herein is achieved since the surface of the anvil 40 will trace the upper edge of the knife 72*b* to define an apperature of the shape illustrated.

While the above described embodiment of the present invention projects the knife 72 toward the anvil 40 in order to effect cutting of the web, cutting can also be achieved by moving the anvil 40 toward and in contact with the knife 70. An exemplary construction showing such a mode of operation is shown in FIG. 8 wherein like components are identified by the same numerals. To move the anvil 40 toward and away from the knife 70 a solenoid 88 has its armature connected to a lever 90 pivotally connected at 92 to a fixed frame member (not shown) and it is pivotally connected at 94 to a rod or shaft 96 defining an extension of the shaft 26. To accommodate vertical reciprocating movement of the shaft 26 and yet impart torque to the pulley 28, the shaft 26 is formed with a spline in the portion residing within a splined bushing 98. The shaft 96 is slidably mounted in fixed brackets 100. In order to adjust the contact pressure between the anvil 40 and the knife 70, springs 102 located between the brackets 100 and adjustable collars 104, are associated with the shaft 96. According to this construction when the solenoid 88 is energized displacing the shaft 96 downwardly a portion of the output force of the solenoid is absorbed or countered by the spring 102 which may be adjusted by movement of its associated collar 104 to achieve a contact pressure between the anvil 40 and the knife 70 which is judged to achieve proper cutting.

In accordance with current practice, the waste material resulting from producing the aperature in the web, is disposed of by connecting a hose 106 to the cavity or opening 66. The hose is conventionally connected to a source of vacuum and to a suitable container for accumulating the waste.

Although the best mode contemplated for carrying out the present invention has been herein shown and described, it will be apparent that modification and variation may be made without departing from what is regarded to be the subject matter of the invention.

What is claimed is:

1. An apparatus for cutting an aperature of a selected non-linear configuration in thin web material comprising a knife having a cutting edge located in a plane and formed to define the selected configuration;

means for tangentially engaging the cutting edge with sufficient force to penetrate a web adjacent the cutting edge; means for rotating said tangentially engaging means about an axis contained within the projected area defined by the cutting edges; and means for translating the cutting edge engaging means along the cutting edge at least until the web overlaying the cutting edge has been cut.

2. The cutting apparatus according to claim 1 wherein said tangentially engaging means comprises an anvil having an conical surface that defines such tangential engagement with the cutting edge.

3. The cutting apparatus according to claim 2 further comprising means for displacing the knife in forceable engagement with said anvil.

4. The cutting apparatus according to claim 2 further comprising means for displacing the anvil in forceable engagement with said knife.

5. An apparatus for cutting an aperature having a non-linear configuration in thin web material comprising a reciprocable support mounting a knife, said support located closely adjacent to a strip of web material, a stationary support located in alignment with and on the opposite side of the web material, said stationary support rotatably mounting a composite shaft having one portion rotating about an axis normal to the web material and another portion having its axis of symmetry defining an acute angle with the axis of said one portion, said another portion of said composite shaft freely rotatably mounting an anvil in the form of a shallow cone having its apex coincident with the intersection the axes of the composite shaft, means for rotating said composite shaft, and means displacing said reciprocable support to establish contact of said knife with said anvil.

6. The cutting apparatus according to claim 5 wherein the apex of said anvil is located and maintained on one side of the edge of said knife.

* * * * *